US010557337B2

(12) United States Patent
Ayub et al.

(10) Patent No.: US 10,557,337 B2
(45) Date of Patent: Feb. 11, 2020

(54) DOWNHOLE CENTRIFUGAL SEPARATION AND REMOVAL OF SAND FROM WELLS USING PROGRESSING CAVITY PUMP

(71) Applicant: Saudi Arabian Oil Company, Dhahran (SA)

(72) Inventors: Muhammad Ayub, Dhahran (SA); Rafael Adolfo Lastra, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 201 days.

(21) Appl. No.: 15/726,083

(22) Filed: Oct. 5, 2017

(65) Prior Publication Data

US 2019/0106973 A1 Apr. 11, 2019

(51) Int. Cl.
*E21B 43/38* (2006.01)
*E21B 43/12* (2006.01)

(52) U.S. Cl.
CPC ..... *E21B 43/385* (2013.01); *E21B 43/128* (2013.01)

(58) Field of Classification Search
CPC ..... E21B 43/34–43/40
See application file for complete search history.

(56) References Cited

U.S. PATENT DOCUMENTS 1,476,747 A 12/1923 Wolever
1,547,285 A 7/1925 Armstrong
1,554,691 A * 9/1925 Reardon ..... E21B 37/00 166/223
2,213,987 A 9/1940 Layne
3,289,608 A 12/1966 Laval, Jr.
3,963,073 A 6/1976 Laval, Jr.
4,072,481 A 2/1978 Laval, Jr.
(Continued)

FOREIGN PATENT DOCUMENTS

CN 205422676 U 8/2016
EP 0165223 A1 12/1985
GB 2365046 A 2/2002

OTHER PUBLICATIONS

International Search Report and Written Opinion for related PCT application PCT/US2017/064865 dated Mar. 1, 2018.
(Continued)

*Primary Examiner* — Shane Bomar
*Assistant Examiner* — Steven A MacDonald
(74) *Attorney, Agent, or Firm* — Bracewell LLP; Constance G. Rhebergen; Linda L. Morgan

(57) ABSTRACT

Systems and methods for removing sand from fluid in a subterranean hydrocarbon development well include producing a cyclonic flow pattern of a sandy fluid of the subterranean well within a wellbore of a subterranean well with tangentially formed openings along a fluid flow path of the sandy fluid. The cyclonic flow pattern causes sand traveling in the sandy fluid to fall downhole as separated sand, and causes a de-sanded fluid stream to be directed uphole towards a production tubing. The de-sanded fluid stream is produced through the production tubing. The separated sand is collected proximate to a suction end of a progressing cavity pump. The progressing cavity pump is operated so that the separated sand flows through the progressing cavity pump and out a discharge end of the progressing cavity pump, to produce the separated sand through a sand discharge tube.

22 Claims, 9 Drawing Sheets

(56) References Cited

U.S. PATENT DOCUMENTS 4,148,735 A 4/1979 Laval, Jr.
4,392,529 A 7/1983 Burwell
4,406,499 A * 9/1983 Yildirim ..... E21B 43/24 166/285
4,621,693 A * 11/1986 Caldwell ..... E21B 37/00 166/105.1
5,033,545 A 7/1991 Sudol
5,209,293 A 5/1993 McNaughton et al.
5,295,537 A * 3/1994 Trainer ..... E21B 43/38 166/105.1
5,447,200 A 9/1995 Dedora et al.
5,553,669 A * 9/1996 Trainer ..... B01D 29/114 166/105.1
5,711,374 A * 1/1998 Kjos ..... B01D 17/0217 166/265
5,979,559 A * 11/1999 Kennedy ..... E21B 43/121 166/106
6,015,011 A 1/2000 Hunter
6,082,452 A * 7/2000 Shaw ..... B04C 5/00 166/105.5
6,089,322 A * 7/2000 Kelley ..... E21B 43/38 166/370
6,119,870 A 9/2000 Maciejewski et al.
6,167,960 B1 * 1/2001 Moya ..... E21B 41/0078 166/105.1
6,189,613 B1 * 2/2001 Chachula ..... E21B 43/385 166/105.5
6,216,788 B1 * 4/2001 Wilson ..... E21B 37/00 166/105.1
6,371,206 B1 4/2002 Mills
6,394,183 B1 * 5/2002 Schrenkel ..... E21B 43/38 166/265
6,619,390 B1 9/2003 Kellett, III
7,905,291 B2 3/2011 Kotsonis et al.
7,909,092 B2 3/2011 Cobb et al.
8,079,753 B2 12/2011 Sebree
8,844,614 B2 9/2014 Brown et al.
9,045,980 B1 6/2015 Botts
9,273,539 B2 3/2016 Raglin
9,359,879 B2 6/2016 Gill et al.
2006/0118303 A1 * 6/2006 Schultz ..... E21B 43/088 166/297
2006/0231257 A1 10/2006 Reed et al.
2009/0078422 A1 3/2009 Manson
2009/0173501 A1 7/2009 Kotsonis et al.
2010/0175869 A1 * 7/2010 Cobb ..... B04C 5/081 166/105.1
2013/0032352 A1 2/2013 Raglin
2013/0037264 A1 * 2/2013 Brown ..... E21B 43/119 166/265
2013/0319956 A1 * 12/2013 Tetzlaff ..... B04C 9/00 210/787
2013/0327727 A1 * 12/2013 Hopper ..... B01D 17/0217 210/787
2014/0174734 A1 * 6/2014 Gill ..... E21B 43/38 166/265
2015/0226046 A1 8/2015 Wolf et al.
2015/0233228 A1 * 8/2015 Roth ..... E21B 43/128 166/372
2016/0251951 A1 9/2016 Stachowiak et al.
2017/0211366 A1 * 7/2017 Xiao ..... F04D 13/10
2018/0156021 A1 * 6/2018 Ayub ..... E21B 43/38
2019/0093467 A1 * 3/2019 Webber ..... E21B 43/38

OTHER PUBLICATIONS

The International Search Report and Written Opinion for related PCT application PCT/US2018/054589 dated Feb. 1, 2019.
"Down Hole Separators (DHS)", A brochure published by LAKOS Separators and Filtration Solution, www.lakos.com.
Andrews, et al,"Production Enhancement from Sand Management Philosophy—A Case Study from Statfjord and Gullfaks", SPE 94511, paper presented at the SPE 6th European Formation Damage Conference, Scheveningen, The Netherlands, May 25-27, 2005.
Dusseault, et al., "Heavy-Oil Production Enhancement by Encouraging Sand Production", SPE 59276, paper presented at the 2000 SPE/DOE Improved Oil Recovery Symposium, Tulsa, Oklahoma, USA, Apr. 3-5, 2000.
Geilikman, et al., "Fluid Production Enhancement by Exploiting Sand Production", SPE/DOE 27797, paper presented at 9th SPE/DOE Improved Oil Recovery Symposium, Tulsa, Oklahoma, USA, Apr. 17-20, 1994.
Lidwin, et al.,"Novel Approach in Sand Production Management—Produce It!", IPTC 16454, paper presented at the International Petroleum Technology Conference, Beijing, China, Mar. 26-28, 2013.
Ogunsina, O. O.: "A Review of Downhole Separation Technology", SPE 94276, paper presented at the 2005 SPE Production and Operations Symposium, Oklahoma City, OK, USA, Apr. 17-19, 2005.
Selfridge, et al, "Safely Improving Production Performance Through Improved Sand Management", SPE 83979, paper presented at Offshore Europe 2003, Aberdeen, UK, Sep. 2-5, 2003.
Wang, et al, "Enhanced Oil Production Owing to Sand Flow in Conventional and Heavy-Oil Reservoirs", SPE Reservoir Evaluation & Engineering, pp. 366-374, Oct. 2001.

* cited by examiner

DOWNHOLE CENTRIFUGAL SEPARATION AND REMOVAL OF SAND FROM WELLS USING PROGRESSING CAVITY PUMP

BACKGROUND OF THE DISCLOSURE

1. Field of the Disclosure

This disclosure relates generally to sand and fluid separation, and more particularly to the removal of sand from a from fluid in a subterranean hydrocarbon development well.

2. Description of the Related Art

The production of formation sand from sandstone reservoirs into a well is well-known in the petroleum industry and for both hydrocarbon and water wells. Excessive sand production is very common from unconsolidated, poorly cemented and relatively young geological formations. Moreover consolidated formations, in many regions of the world, are not completely free from this problem; they also release sand, though may not be excessively high in volume. Sand production also creates similar problems in fractured wells; where, to improve well productivity, a huge quantity of sand, also known as proppant, is injected into hydraulically generated fractures in rocks around wellbores. Some of the sand stays in fractures to keep them propped; while significant amount of sand can flow back towards wellbores and creates problems.

Formation sand production can not only plug wells, but also can erode downhole equipment, artificial lift systems, wellhead assemblies and the surface facilities. Consequently many operators can suffer from significant loss of productivity and the loss of equipment both downhole and at the surface. Some operators attempt to control sand production to minimize or eliminate such losses.

Typical sand control methods include use of various types of sand screens, slotted liners, gravel-pack schemes, and near wellbore sand consolidation techniques by various chemicals. While these techniques can perform reasonably satisfactory to minimize the production of sand under various operational conditions for various formations, an adverse effect of some current sand control techniques is that they may reduce overall flow capacity of formation fluids, such as oil, gas, and water, towards the wellbores.

SUMMARY OF THE DISCLOSURE

Embodiments of this disclosure include systems and methods for separating sand from oil, gas and water as they enter the wellbore from the reservoir. Within a wellbore, the centrifugal separation can be performed by generating a spiral or cyclonic flow pattern. Such flow pattern can be generated by using a tangential perforation design or a specially designed screen system. Because of the spiral flow pattern of the oil, gas, or water carrying the sand within wellbore, sand as a heavier component would flow outward along the well sides, where oil, gas or water as lighter component would stay in the middle of wellbore and flow upward through the production tubing. The separated sand would fall down the wellbore through a one-way flip valve and be collected in a sand chamber. The lower-end of the sand chamber can release the collected sand towards the intake side of a progressing cavity pump for removal to the surface through a sand discharge tube.

Systems and methods of this disclosure which provide centrifugal sand separation and then sand removal by progressing cavity pump, not only improves oil and gas recovery, but also can significantly improve the operating lifespan of downhole completion equipment, artificial lift systems and the surface facilities. Embodiments of this disclosure can be used in cased-holes, open-holes, consolidated formations and unconsolidated formations. Moreover, the technique may be used for both vertical and horizontal wells. It has been observed that sand grains produced from deeper regions of the formation can improve permeability and effective porosity network which may help to improve the productivity of reservoir fluids. Systems and methods of this disclosure provide a sand control methodology that both minimizes the negative impacts of sand production and improves productivity caused by restraining the flow of sand, relative to some current sand control systems.

In an embodiment of this disclosure a method for removing sand from fluid in a subterranean hydrocarbon development well includes producing a cyclonic flow pattern of a sandy fluid of a subterranean well within a wellbore of a subterranean well with tangentially formed openings along a fluid flow path of the sandy fluid, where the cyclonic flow pattern causes sand traveling in the sandy fluid to fall downhole as separated sand, and causes a de-sanded fluid stream to be directed uphole towards a production tubing. The de-sanded fluid stream is produced through the production tubing. The separated sand is collected proximate to a suction end of a progressing cavity pump. The progressing cavity pump is operated so that the separated sand flows through the progressing cavity pump and out a discharge end of the progressing cavity pump, to produce the separated sand through a sand discharge tube.

In alternate embodiments, a flow path of the sand discharge tube can be separate from a flow path of the production tubing. The tangentially formed openings can be located in a sidewall of a cyclonic separator located within the wellbore or can be tangentially oriented perforations within a reservoir formation. Water can be added to the separated sand to form a sand slurry before producing the sand slurry through the sand discharge tube and the de-sanded fluid stream is a dry gas.

In other alternate embodiments, the method can further include cooling the progressing cavity pump with a water cooling system. The water cooling system can include a duplex umbilical tube with a cooling water pumped into the wellbore through a first bore of the duplex umbilical tube and the cooling water can be pumped out of the wellbore through a second bore of the duplex umbilical tube. The sandy fluid can be produced from a horizontal section of the subterranean hydrocarbon development well.

In another alternate embodiment of this disclosure, a method for removing sand from fluid in a subterranean hydrocarbon development well includes producing a cyclonic flow pattern of a sandy fluid of a subterranean well within a wellbore of a subterranean well with tangentially oriented perforations within a reservoir formation, where the cyclonic flow pattern causes sand traveling in the sandy fluid to fall downhole as separated sand, and causes a de-sanded fluid stream to be directed uphole towards a production tubing. The de-sanded fluid stream can be produced through the production tubing. The separated sand can be produced through a sand discharge tube that is separate from a flow path of the production tubing.

In alternate embodiments, the separated sand can flow through a progressing cavity pump to produce the separated sand in the sand discharge tube. The progressing cavity pump can be cooled with a water cooling system. The water cooling system can include a duplex umbilical tube with a cooling water pumped into the wellbore through a first bore of the duplex umbilical tube and the cooling water can be pumped out of the wellbore through a second bore of the duplex umbilical tube. Water can be added to the separated sand to form a sand slurry before producing the sand slurry through the sand discharge tube and the de-sanded fluid stream can be a dry gas. The sandy fluid can be produced from a horizontal section of the subterranean hydrocarbon development well.

In another alternate embodiment of the disclosure, a system for removing sand from fluid in a subterranean hydrocarbon development well includes tangentially formed openings along a fluid flow path of the sandy fluid, the tangentially formed openings oriented for producing a cyclonic flow pattern of a sandy fluid of a subterranean well within a wellbore of the subterranean well, where the cyclonic flow pattern causes sand traveling in the sandy fluid to fall downhole as separated sand, and causes a de-sanded fluid stream to be directed uphole. Production tubing includes a fluid flow path for producing the de-sanded fluid stream. A progressing cavity pump has a suction end and is positioned such that the separated sand collects proximate to the suction end, flows through the progressing cavity pump, and travels out a discharge end of the progressing cavity pump. A sand discharge tube includes a fluid flow path for producing the separated sand.

In alternate embodiments, the fluid flow path of the sand discharge tube can be separate from the fluid flow path of the production tubing. The tangentially formed openings can be located in a sidewall of a cyclonic separator located within the wellbore or can be tangentially oriented perforations within a reservoir formation. A one way valve can be located between the cyclonic flow pattern and the progressing cavity pump. A slurry water can be added to the separated sand to form a sand slurry before producing the sand slurry through the sand discharge tube. The de-sanded fluid stream can be a dry gas.

In other alternate embodiments, a water cooling system can include a duplex umbilical tube with a first bore of the duplex umbilical tube operable for pumping cooling water into the wellbore and a second bore of the duplex umbilical tube operable for pumping the cooling water out of the wellbore. The subterranean hydrocarbon development well can have a horizontal section operable for producing the sandy fluid.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
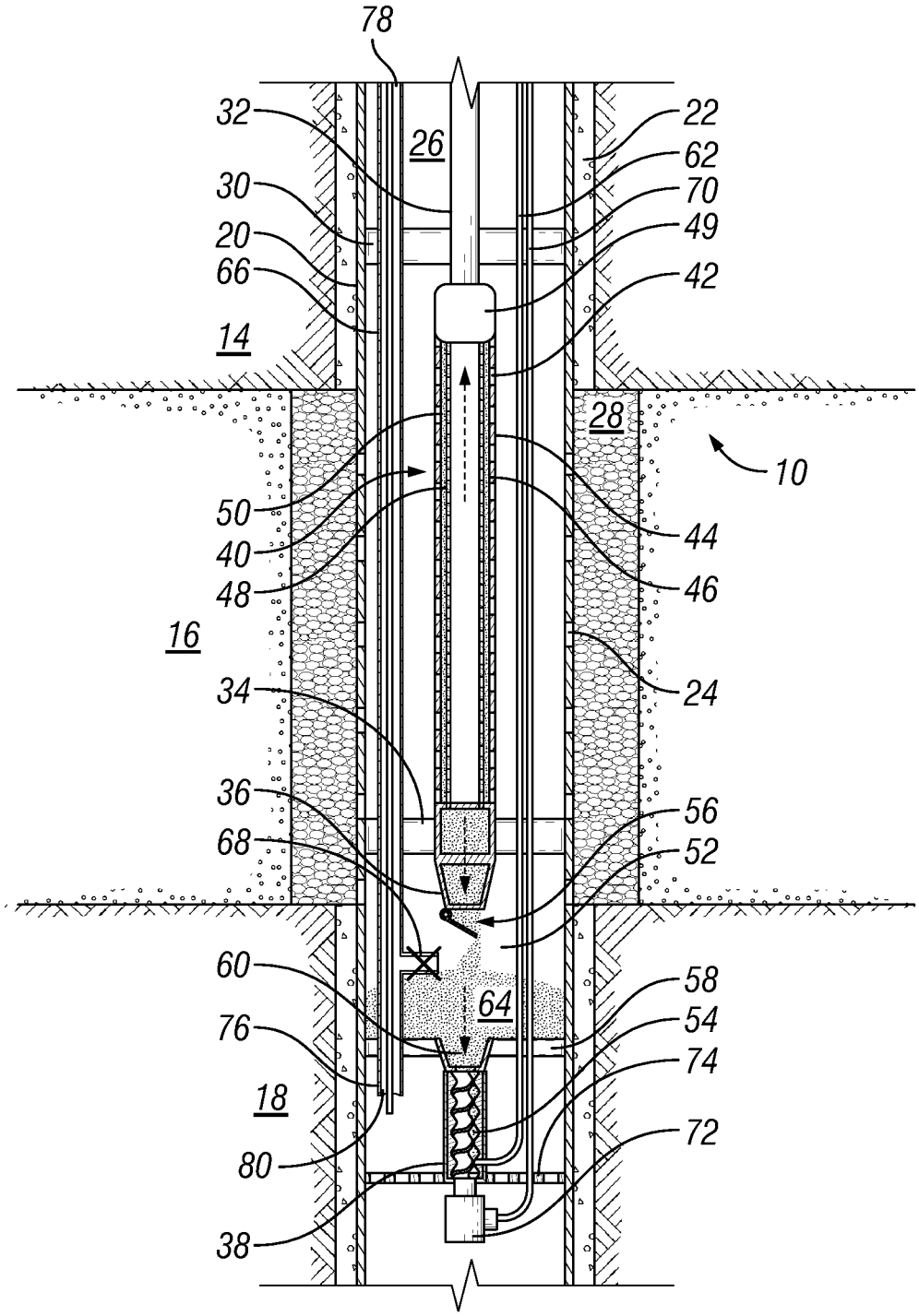
FIG. 1 is a sectional elevation view of a subterranean hydrocarbon development well with a sand separation system and a sand removal system in accordance with an embodiment of this disclosure.

Looking at FIG. 1, subterranean well 10 can be a subterranean hydrocarbon development well for producing oil, gas, or water, or any combination of oil, gas or water. Subterranean well 10 can extend from the surface, through cap rock 14, and into reservoir formation 16. Subterranean well 10 can end in reservoir formation 16 or extend into underlying rock 18.

Subterranean well 10 can be cased with casing 20 that is surrounded by cement 22. A portion of casing 20 that is located within reservoir formation 16 can have openings 24 to provide a flow path between reservoir formation 16 and into wellbore 26 of subterranean well 10. In certain embodiments such as when reservoir formation 16 includes unconsolidated reservoir rocks, gravel pack 28 can surround casing 20 within reservoir formation 16. In alternate embodiments such as when reservoir formation 16 includes consolidated reservoir rocks, all or a portion of subterranean well 10 can be uncased so that subterranean well 10 includes an open-hole (not shown).

Upper packer 30 can be located uphole from openings 24. Upper packer 30 seals across wellbore 26 and around production tubing 32 to prevent a flow from passing by upper packer 30 outside of production tubing 32. Production tubing 32 includes an internal bore that provides a flow path for producing a de-sanded fluid stream, such as delivering a de-sanded fluid stream to the surface. Lower packer 34 can be located downhole from openings 24. Lower packer 34 seals across wellbore 26 and around sand discharge assembly 36 to prevent a flow from passing by lower packer 34 outside of sand discharge assembly 36. Sand discharge assembly 36 directs separated sand towards sand removal system 38.

As used in this disclosure, the term "uphole" refers to a position closer to the surface measured along the axis of the well than the compared position, regardless of the orientation of the axis of the well. As used in this disclosure, the term "downhole" refers to a position farther from the surface measured along the axis of the well than the compared position, regardless of the orientation of the axis of the well. As an example, in a horizontal portion of subterranean well 10, a position uphole may be at the same vertical depth below the surface as the compared position.

Separation system 40 can separate sand from a sandy fluid of the subterranean well 10. The sandy fluid can be oil, gas, or water, or any combination of oil, gas, or water, that carries sand. The sandy fluid enters subterranean well 10 through openings 24. Separation system 40 has tangentially formed openings 42 along a fluid flow path of the sandy fluid that produces a cyclonic flow pattern of the sandy fluid within wellbore 26. The cyclonic flow pattern of sandy fluid is produced solely by the tangentially formed openings 42 and no rotating components are required to generate the cyclonic flow pattern. It is reservoir pressure that is used in combination with tangentially formed openings 42 to generate the centrifugal force that separates sand. Therefore the amount of sand removed from the sandy fluid is directly proportional to the pressure and flow rate of the sandy fluid and embodiments of this disclosure are particularly well suited for high pressure reservoirs.

In the embodiment of FIG. 1, tangentially formed openings 42 are located in a sidewall of cyclonic separator 44 located within wellbore 26. Cyclonic separator 44 can have outer screen 46 and inner screen 48 and tangentially formed openings 42 can be located in one or both of the outer screen 46 and inner screen 48. Cyclonic separator 44 can be supported within wellbore 26 by screen hanger 49.

Due to centrifugal forces, the cyclonic flow pattern causes sand traveling in the sandy fluid, which is a heavier or more dense component of the sandy fluid, to move radially outward and fall downhole as separated sand. The separated sand can flow downhole in the annular space 50 between outer screen 46 and inner screen 48. The separated sand can pass through sand discharge assembly 36 and collect in sand collection chamber 52 that is proximate to a suction end of progressing cavity pump 54 of sand removal system 38. Oil, gas, and water, as the lighter components will be concentrated along a radially central section of wellbore 26 as a de-sanded fluid stream and will be directed uphole towards production tubing 32. The de-sanded fluid can be produced through production tubing 32.

Sand discharge assembly 36 can include a generally frustoconical shaped passage that directs separated sand through lower packer 34. Sand discharge assembly 36 can also include one way valve 56. One way valve 56 is located between the cyclonic flow pattern and progressing cavity pump 54. The operation of the one way valve 56 can be triggered automatically when enough separated sand has accumulated in sand discharge assembly 36 above progressing cavity pump 54. When enough separated sand has accumulated in sand discharge assembly 36, one way valve 56 can open to allow the separated sand to pass through one way valve 56 and enter sand collection chamber 52.

Sand collection chamber 52 is defined within an inner diameter of wellbore 26 between lower packer 34 and sand removal packer 58. Sand removal packer 58 seals across wellbore 26 and around intake aperture 60 to prevent a flow from passing by lower packer 34 outside of sand discharge assembly 36. Intake aperture 60 provides a flow path between sand collection chamber 52 and the intake of progressing cavity pump 54.

Progressing cavity pump 54 can be operated so that the separated sand flows through progressing cavity pump 54 and out discharge end of progressing cavity pump 54, to produce the separated sand through sand discharge tube 62. Sand discharge tube 62 includes an internal bore that provides a fluid flow path for producing separated sand, such as delivering separated sand to the surface. The fluid flow path of sand discharge tube 62 is separate from the fluid flow path of production tubing 32 so that the separated sand is produced separately from the de-sanded fluid stream.

For an efficient operation of progressing cavity pump 54 the pump intake is provided with a wet sand slurry 64 that is with a mixture of sand and a liquid, such as water or oil. In some cases, to improve the pumpability of the separated sand, additional water may be needed for improved fluidity of the accumulated sand. In certain embodiments, before entering progressing cavity pump 54, a slurry water can be added to the separated sand to form sand slurry 64 with improved pumpability compared to a dry sand. The slurry water can be provided through umbilical 66 and the flow of slurry water can be controlled by water valve 68. Slurry water may be useful, for example, where the de-sanded fluid stream is a dry gas, where there is otherwise insufficient liquid, such as oil or water, being produced to form a sand slurry suitable for efficient pumping with progressing cavity pump 54, or where there has been sand solidification within sand collection chamber 52. The sand and liquid mixture produced at the surface can further be treated to separate sand for disposal and the liquid can be used for recirculation.

Progressing cavity pump 54 can be operated by electrical power supplied by power cable 70 from the surface that is connected to progressing cavity pump motor 72. Progressing cavity pump motor 72 can be used to power only progressing cavity pump 54 or can be a motor that is shared with other downhole equipment. In alternate embodiments, progressing cavity pump 54 can be powered by a hydraulic motor (not shown) or other known means for powering a downhole pump. Although separation system 40 has been shown as a cyclonic separator, in embodiments where an alternate or additional separator is used, electrical or hydraulic power for progressing cavity pump 54 can be provided by or shared with such alternate or additional separator.

Progressing cavity pump 54 can pump sand without significant wear and tear at the relatively greater discharge pressures required to transport thick sand slurry from bottom of wellbore 26 to all the way to the surface. The operation of progressing cavity pump 54 can be continuous or cyclic and may be automated depending on the rate of sand accumulation. That is, for greater or faster sand accumulation progressing cavity pump 54 could be operated on continuous basis, where for reduced sand production rates progressing cavity pump 54 could be automatically turned on when sufficient sand is collected in sand collection chamber 52.

In order to maintain the stability of progressing cavity pump 54 and to mitigate vibrations of progressing cavity pump 54 pump centralizer 74 can circumscribe progressing cavity pump 54. Pump centralizer 74 maintains progressing cavity pump 54 in the center of wellbore 26 and provides the necessary rigidity for progressing cavity pump 54 rotation.

If progressing cavity pump 54 overheats, a water cooling system can be used to cool progressing cavity pump 54. The water cooling system can utilize umbilical 76 to deliver cooling water to progressing cavity pump 54. Umbilical 76 can be a duplex umbilical tube having a first bore 78 for pumping cooling water into wellbore 26 and a second bore 80 for pumping cooling water out of wellbore 26 after circulating cooling water through progressing cavity pump 54. Umbilical 76 used for cooling water can be umbilical 66 that is used for slurry water. Alternately, umbilical 76 can be separate from umbilical 66.

Figure 2:
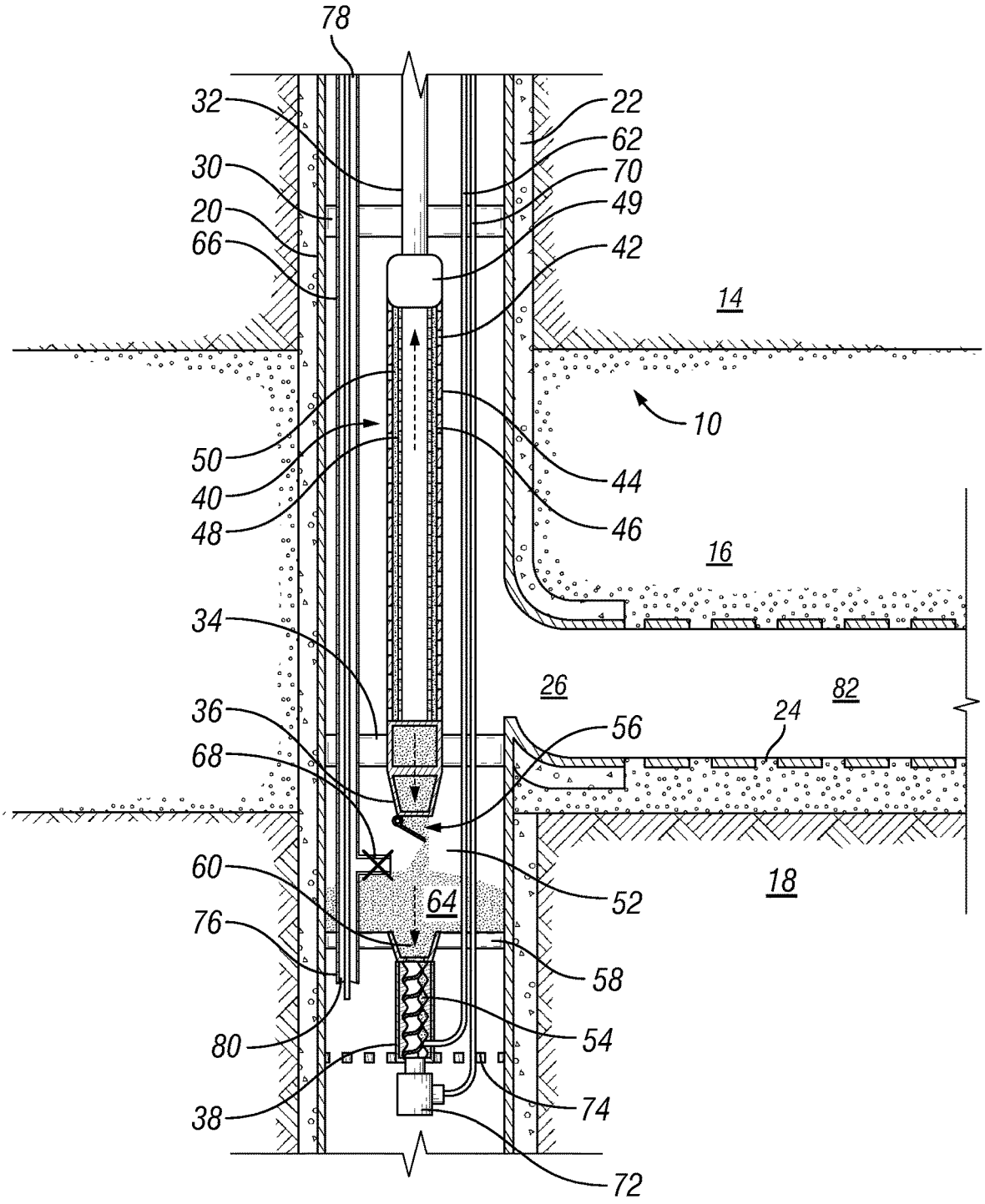
FIG. 2 is a sectional elevation view of a subterranean hydrocarbon development well with a sand separation system and a sand removal system, and shown with a horizontal section of subterranean well, in accordance with an alternate embodiment of this disclosure.

Looking at FIG. 2, subterranean well 10 can include horizontal section 82 operable for producing the sandy fluid. In embodiments where the sandy fluid is produced from horizontal section 82, to accommodate separation system 40 and sand removal system 38, some additional vertical well section is below the starting point of horizontal section 82. A consideration when producing sandy fluid from horizontal section 82 is that because of gravity, some of the produced sand may settled-down in horizontal section 82. However for high pressure wells, flow rates are usually high enough that all or a majority of the sand would flow with the sandy fluid to separation system 40.

In the embodiment of FIG. 2 there is no gravel pack, but instead cement 22 surrounds casing 20 within reservoir formation 16 and openings 24 pass through both casing 20 and cement 22.

Figure 3:
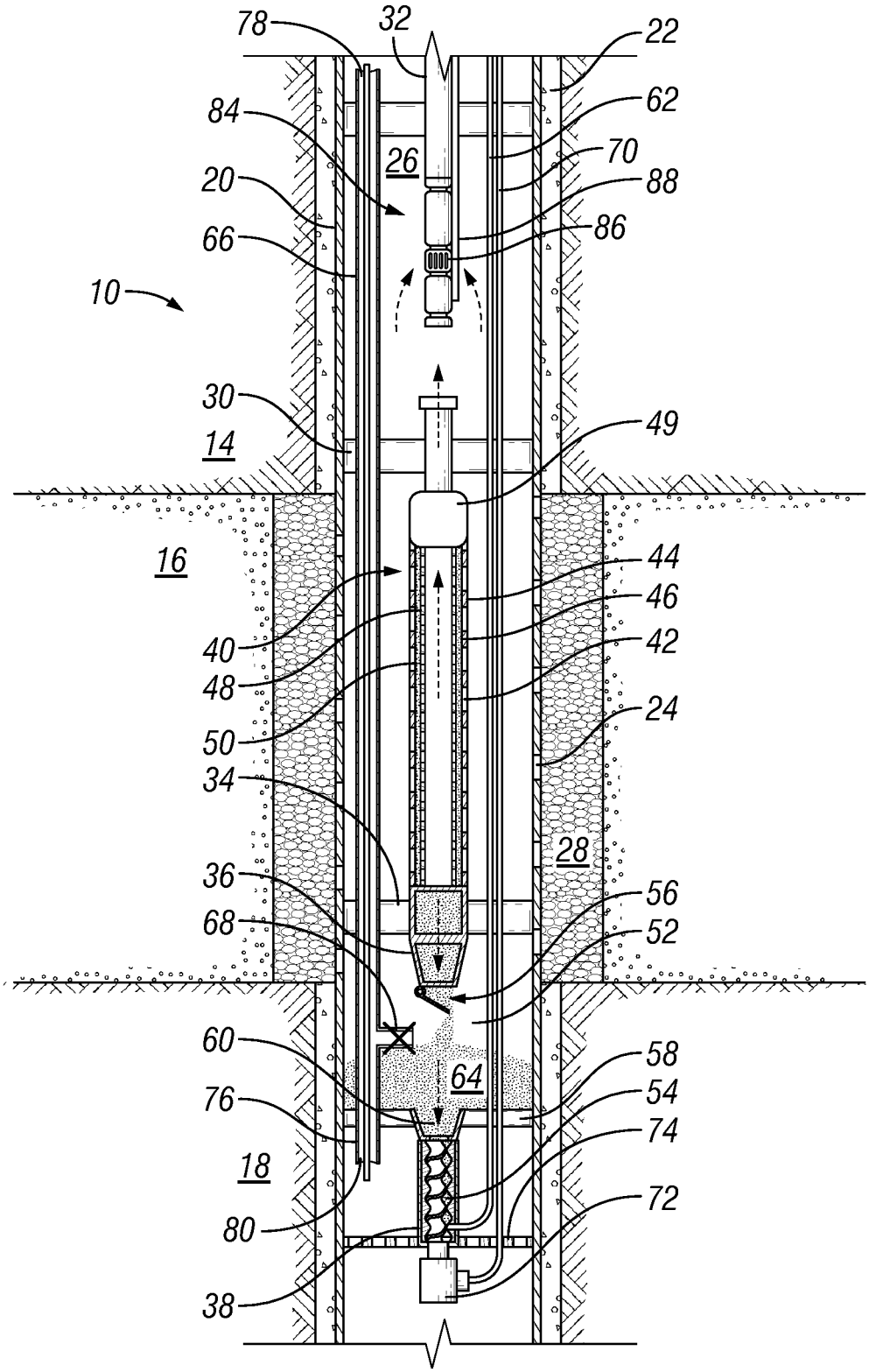
FIG. 3 is a sectional elevation view of a subterranean hydrocarbon development well with a sand separation system and a sand removal system, and shown with an artificial lift system, in accordance with an alternate embodiment of this disclosure.

Looking at FIG. 3, in order to improve production from subterranean well 10, downhole artificial lift system 84 can be used. In the embodiment of FIG. 3, artificial lift system 84 is shown to include electrical submersible pump 86 that is commonly used in oil and gas wells where natural reservoir energy is not sufficient to lift the fluids all the way to surface. In some current systems, artificial lift system 84 can be severely damaged or can perform poorly because of sand production with well fluids. In embodiment of this disclosure that include artificial lift system 84, artificial lift system 84 can be coupled to production tubing 32 uphole of separation system 40, so that fluids entering artificial lift system 84 are sand-free. In alternate embodiments, alternate pumping systems commonly used to boost production, such as rod-pumps, can be used.

In the embodiment of FIG. 3, artificial lift system 84 has a dedicated lift power cable 88. In alternate embodiments, progressing cavity pump 54 and artificial lift system 84 can share a source of power or the same motor or other suitable driver.

Figure 4:
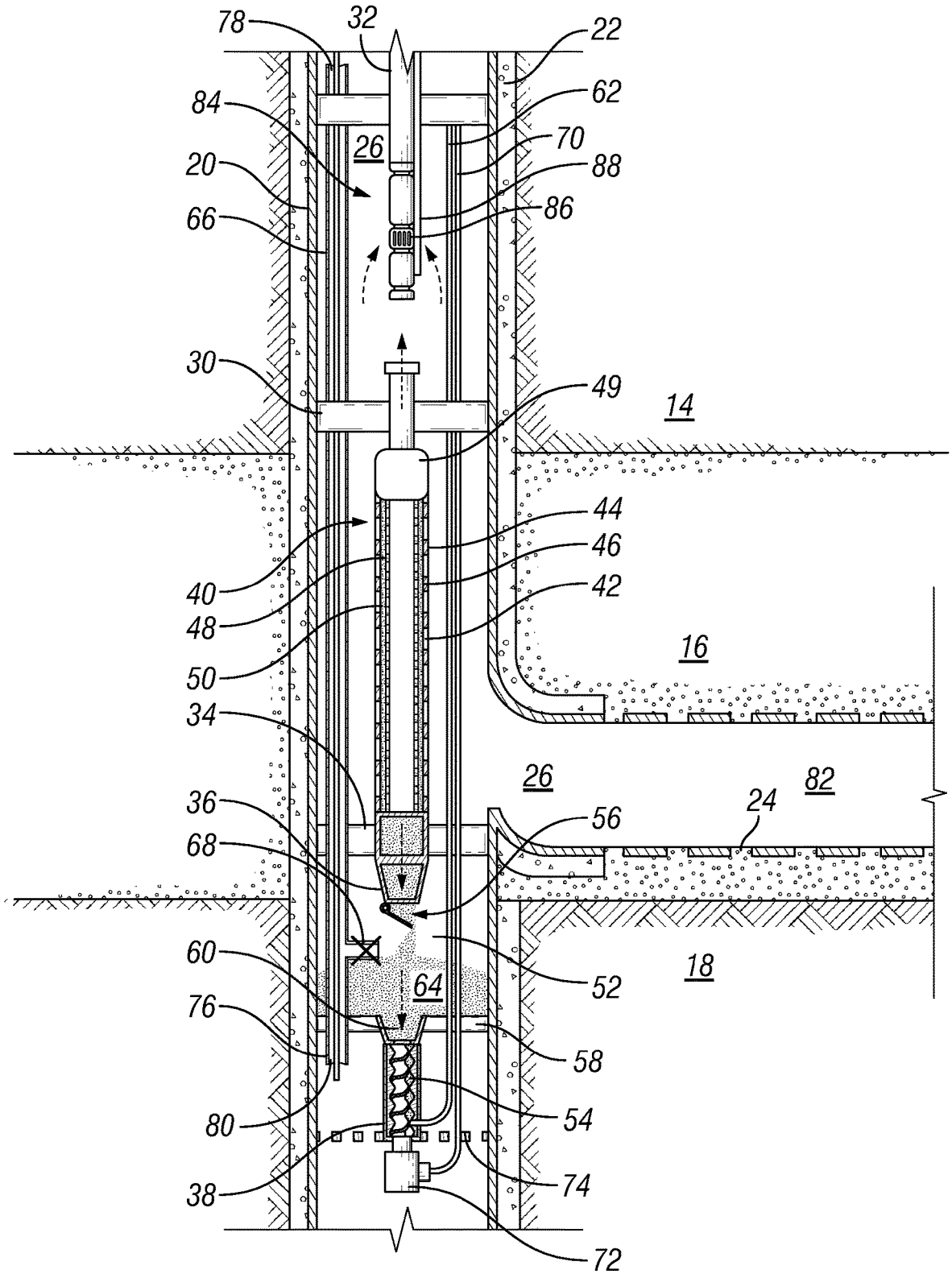
FIG. 4 is a sectional elevation view of a subterranean hydrocarbon development well with a sand separation system and a sand removal system, and shown with an artificial lift system and a horizontal section of subterranean well, in accordance with an alternate embodiment of this disclosure.

Looking at the embodiment of FIG. 4, artificial lift system 84 can also be used in embodiments where the sandy fluid is produced from horizontal section 82.

Figure 5:
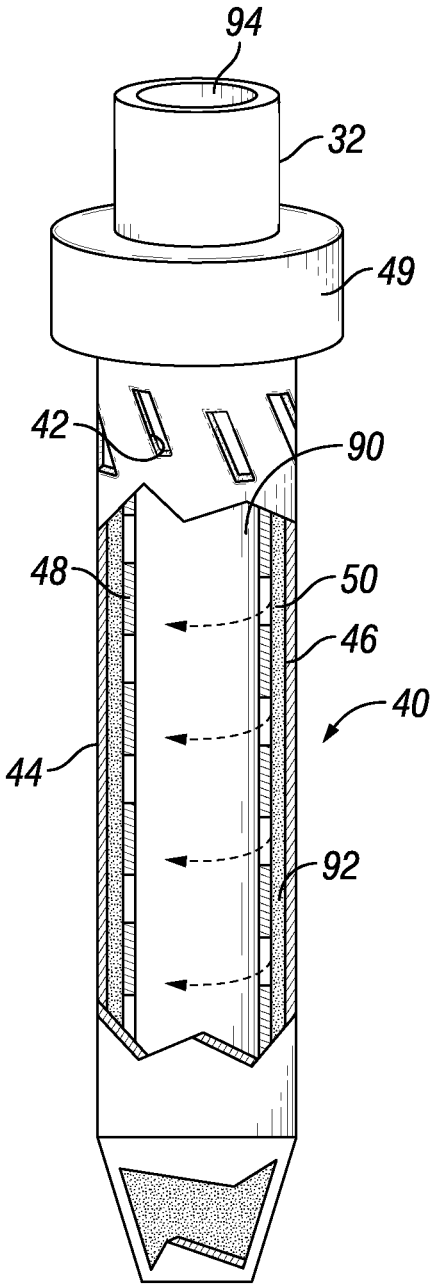
FIG. 5 is a partial sectional elevation view of a sand separation system, in accordance with an embodiment of this disclosure.

Looking at FIG. 5, a detailed view of an example embodiment of separation system 40 is shown. As shown in FIG. 5, sandy fluid 90 enters tangentially formed openings 42 to form a cyclonic flow pattern within cyclonic separator 44. Separated sand 92 flows downhole along the annular space 50 between outer screen 46 and inner screen 48. De-sanded fluid stream 94 flows upward through production tubing 32. In alternate embodiments, there can be no inner screen and tangentially formed openings 42 are located in the single sidewall of cyclonic separator 44 located within wellbore 26 and the separated sand can flow downward along an inner diameter of the single sidewall of cyclonic separator 44.

Figure 6:
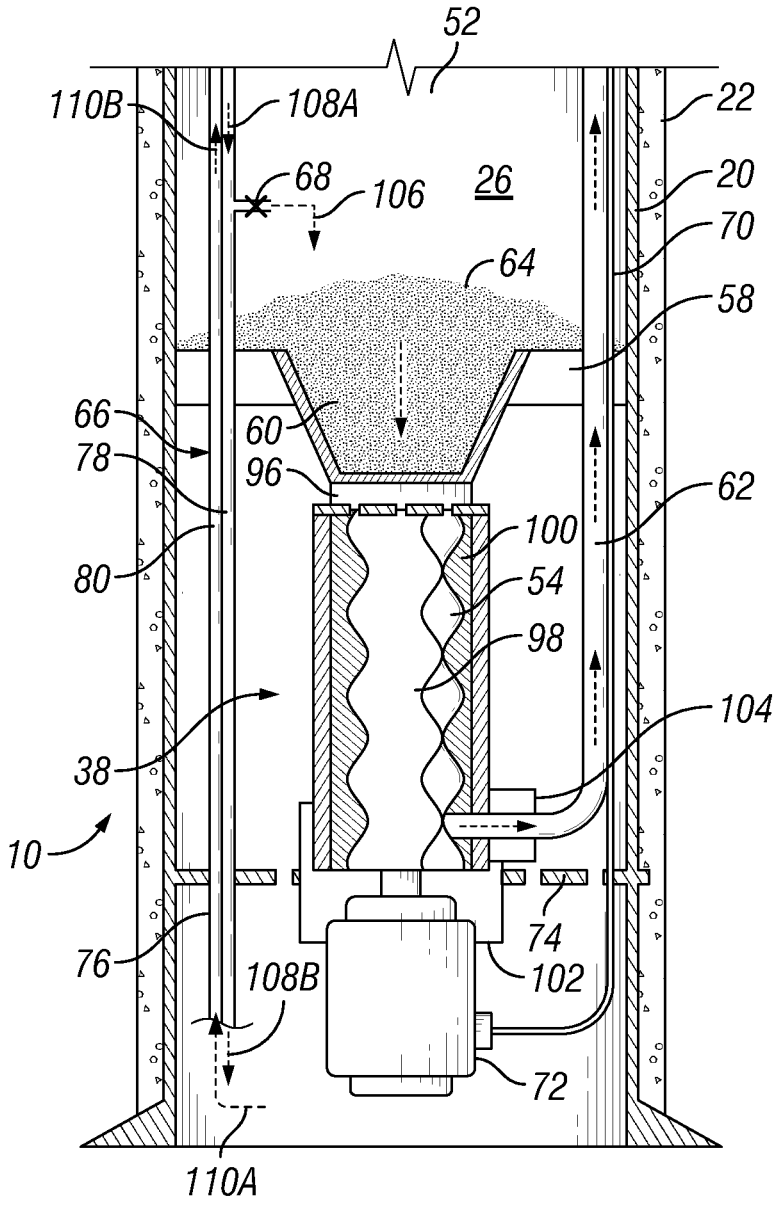
FIG. 6 is a sectional elevation view of a sand removal system, in accordance with an embodiment of this disclosure.

Looking at FIG. 6, a detailed view of an example embodiment of sand removal system 38 is shown. Sand slurry 64 enters pump intake 96 of progressing cavity pump 54. As rotor 98 rotates within stator 100, separated sand is pumped through progressing cavity pump 54. Rotor 98 is rotated with progressing cavity pump motor 72, which is secured to progressing cavity pump 54 with motor coupling 102.

The separated sand exits progressing cavity pump 54 at discharge 104 and is pumped out of subterranean well 10 through sand discharge tube 62. If required, slurry water can be added through water valve 68, as indicated by slurry water flow arrow 106 in order to provide a wet sand slurry 64. If cooling water is required, umbilical 76 can deliver cooling water to progressing cavity pump 54. Cooling water is injected through first bore 78 as indicated by cooling water inflow arrows 108*a*, 108*b*. After circulating cooling water through progressing cavity pump 54, cooling water can be returned to the surface through second bore 80 of umbilical 76, as indicated by cooling water outflow arrows 110*a*, 110*b*.

Figure 7:
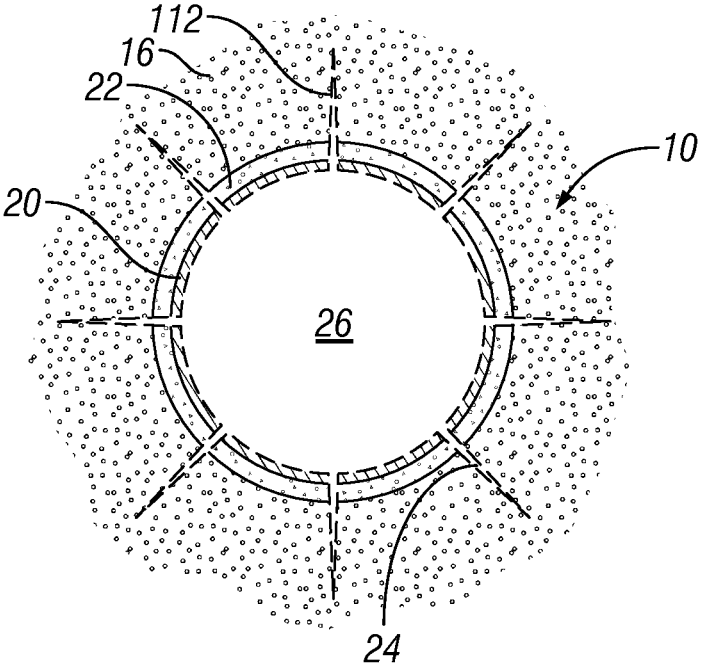
FIG. 7 is a cross sectional view of a subterranean hydrocarbon development well with radially extending perforations, in accordance with an embodiment of this disclosure.
Figure 8:
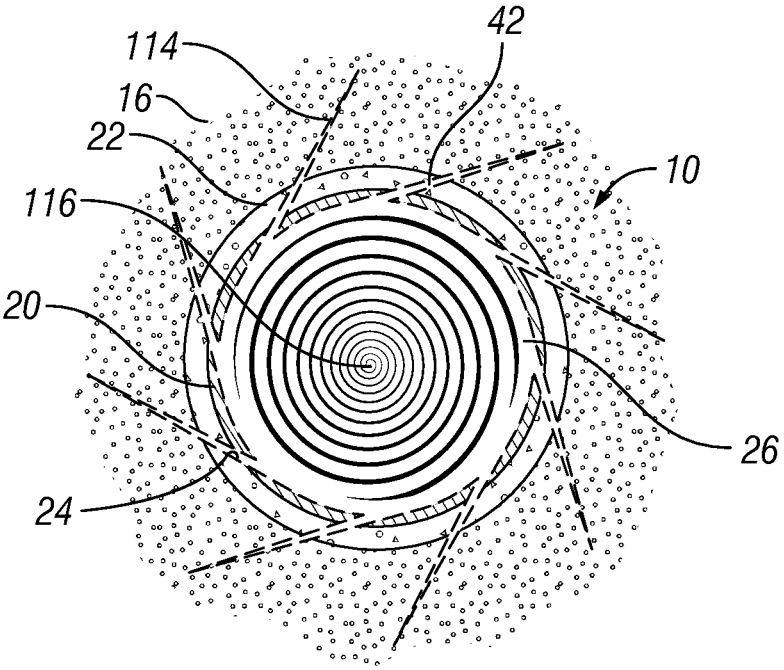
FIG. 8 is a cross sectional view of a subterranean hydrocarbon development well with tangentially oriented perforations, in accordance with an embodiment of this disclosure.

In the example embodiments of FIGS. 1-6, a traditional fracture pattern of radial perforations 112 can extend into reservoir formation 16, as shown in FIG. 7. In alternate embodiments, tangentially oriented perforations 114 can extend into reservoir formation 16, as shown in FIG. 8. In such an embodiment, tangentially formed openings 42 are the tangentially oriented perforations 114. In such embodiments, cyclonic separator 44 is not required. Alternately, tangentially oriented perforations 114 can be used in conjunction with cyclonic separator 44.

Tangentially oriented perforations 114 can be used, for example, in cased hole completions or in open-hole formations in consolidated reservoir formations. The orientation of tangentially oriented perforations 114 form cyclonic flow pattern 116 within wellbore 26.

Figure 9:
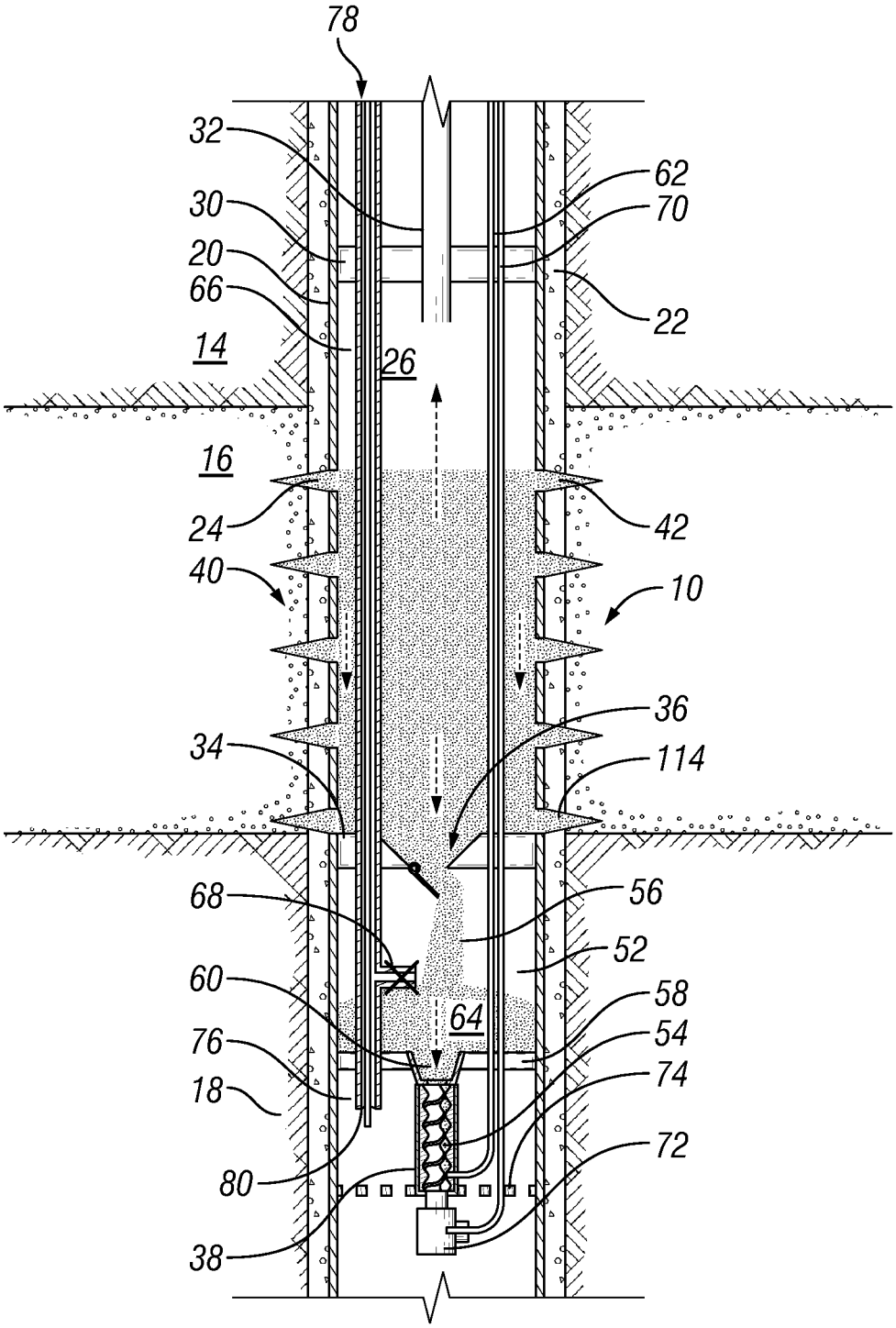
FIG. 9 is a sectional elevation view of a subterranean hydrocarbon development well with a sand separation system and a sand removal system in accordance with an alternate embodiment of this disclosure.
Figure 10:
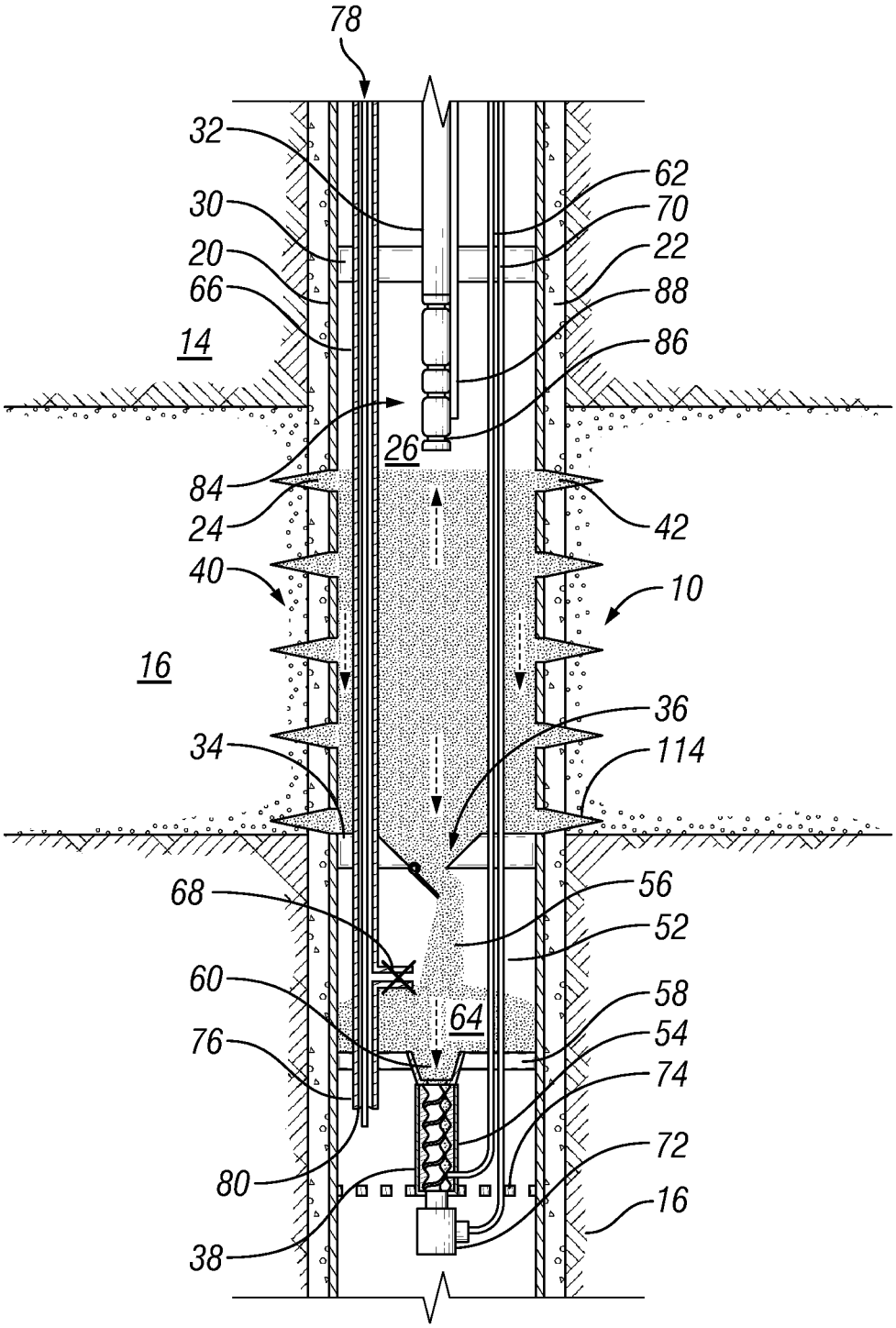
FIG. 10 is a sectional elevation view of a subterranean hydrocarbon development well with a sand separation system and a sand removal system, and shown with an artificial lift system, in accordance with an alternate embodiment of this disclosure.

Looking at FIG. 9, when cyclonic separator 44 is not used, the cyclonic flow pattern cases separated sand to fall downhole along a radially outward portion along the inner diameter of wellbore 26. The separated sand passes through one way valve 56 and enters sand collection chamber 52. The de-sanded fluid stream is directed uphole towards production tubing 32. Looking at FIG. 10, tangentially oriented perforations 114 can additionally be used in conjunction with downhole artificial lift system 84.

In an example of operation, to remove sand from fluid in subterranean well 10 a cyclonic flow pattern of a sandy fluid can be generated within wellbore 26 of subterranean well 10 with tangentially formed openings 42 along a fluid flow path of the sandy fluid. The cyclonic flow pattern causes sand traveling in the sandy fluid to fall downhole as separated sand, and causes a de-sanded fluid stream to be directed uphole towards production tubing 32. The de-sanded fluid stream can be produced through production tubing 32. The separated sand can be collected proximate to a suction end of progressing cavity pump 54. Progressing cavity pump 54 can be operated so that the separated sand flows through progressing cavity pump 54 and out a discharge end of progressing cavity pump 54, to produce the separated sand through sand discharge tube 62.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for removing sand from fluid in a subterranean hydrocarbon development well, the method including:

producing a cyclonic flow pattern of a sandy fluid of a subterranean well within a wellbore of the subterranean well with tangentially formed openings along a fluid flow path of the sandy fluid, where the cyclonic flow pattern causes sand traveling in the sandy fluid to fall downhole as separated sand, and causes a de-sanded fluid stream to be directed uphole towards a production tubing;

producing the de-sanded fluid stream through the production tubing;

collecting the separated sand proximate to a suction end of a progressing cavity pump; and operating the progressing cavity pump so that the separated sand flows through the progressing cavity pump and out a discharge end of the progressing cavity pump, to produce the separated sand through a sand discharge tube, where a flow path of the sand discharge tube is separate from a flow path of the production tubing.

2. The method of claim 1, where the tangentially formed openings are located in a sidewall of a cyclonic separator located within the wellbore.

3. The method of claim 1, where the tangentially formed openings are tangentially oriented perforations within a reservoir formation.

4. The method of claim 1, further including adding water to the separated sand to form a sand slurry before producing the sand slurry through the sand discharge tube.

5. The method of claim 4, where the de-sanded fluid stream is a dry gas.

6. The method of claim 1, further including cooling the progressing cavity pump with a water cooling system.

7. The method of claim 6, where the water cooling system includes a duplex umbilical tube with a cooling water pumped into the wellbore through a first bore of the duplex umbilical tube and the cooling water is pumped out of the wellbore through a second bore of the duplex umbilical tube.

8. The method of claim 1, where the sandy fluid is produced from a horizontal section of the subterranean hydrocarbon development well.

9. A method for removing sand from fluid in a subterranean hydrocarbon development well, the method including:

producing a cyclonic flow pattern of a sandy fluid of a subterranean well within a wellbore of the subterranean well with tangentially oriented perforations within a reservoir formation, where the cyclonic flow pattern causes sand traveling in the sandy fluid to fall downhole as separated sand, and causes a de-sanded fluid stream to be directed uphole towards a production tubing;

producing the de-sanded fluid stream through the production tubing; and producing the separated sand through a sand discharge tube that is separate from a flow path of the production tubing, where the separated sand flows through a progressing cavity pump to produce the separated sand in the sand discharge tube.

10. The method of claim 9, further including cooling the progressing cavity pump with a water cooling system.

11. The method of claim 10, where the water cooling system includes a duplex umbilical tube with a cooling water pumped into the wellbore through a first bore of the duplex umbilical tube and the cooling water is pumped out of the wellbore through a second bore of the duplex umbilical tube.

12. The method of claim 9, further including adding water to the separated sand to form a sand slurry before producing the sand slurry through the sand discharge tube.

13. The method of claim 12, where the de-sanded fluid stream is a dry gas.

14. The method of claim 9, where the sandy fluid is produced from a horizontal section of the subterranean hydrocarbon development well.

15. A system for removing sand from fluid in a subterranean hydrocarbon development well, the system including: tangentially formed openings along a fluid flow path of a sandy fluid of a subterranean well, the tangentially formed openings oriented for producing a cyclonic flow pattern of the sandy fluid within a wellbore of the subterranean well, where the cyclonic flow pattern causes sand traveling in the sandy fluid to fall downhole as separated sand, and causes a de-sanded fluid stream to be directed uphole; production tubing that includes a flow path for producing the de-sanded fluid stream; a progressing cavity pump having a suction end and positioned such that the separated sand collects proximate to the suction end, flows through the progressing cavity pump, and travels out a discharge end of the progressing cavity pump; and a sand discharge tube that includes a flow path for producing the separated sand where an umbilical is configured to add a slurry water to the separated sand to form a sand slurry before producing the sand slurry through the sand discharge tube.

16. The system of claim 15, where the flow path of the sand discharge tube is separate from the flow path of the production tubing.

17. The system of claim 15, where the tangentially formed openings are located in a sidewall of a cyclonic separator located within the wellbore.

18. The system of claim 15, where the tangentially formed openings are tangentially oriented perforations within a reservoir formation.

19. The system of claim 15, further including a one way valve located between the cyclonic flow pattern and the progressing cavity pump.

20. The system of claim 15, where the de-sanded fluid stream is a dry gas.

21. The system of claim 15, further including a water cooling system that includes a duplex umbilical tube with a first bore of the duplex umbilical tube operable for pumping cooling water into the wellbore and a second bore of the duplex umbilical tube operable for pumping the cooling water out of the wellbore.

22. The system of claim 15, where the subterranean hydrocarbon development well has a horizontal section operable for producing the sandy fluid.

* * * * *